US007428470B2

(12) United States Patent
Brown et al.

(10) Patent No.: US 7,428,470 B2
(45) Date of Patent: Sep. 23, 2008

(54) METHOD FOR MONITORING EDGE EXCLUSION DURING CHEMICAL MECHANICAL PLANARIZATION

(75) Inventors: Brian Brown, Palo Alto, CA (US); Paul Franzen, West Linn, OR (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 11/676,320

(22) Filed: Feb. 19, 2007

(65) Prior Publication Data

US 2008/0200099 A1 Aug. 21, 2008

(51) Int. Cl.
*G01B 11/02* (2006.01)

(52) U.S. Cl. ..... 702/170

(58) Field of Classification Search ..... 702/170
See application file for complete search history.

(56) References Cited

U.S. PATENT DOCUMENTS

2003/0058449 A1 * 3/2003 Banet et al. ..... 356/432

* cited by examiner

*Primary Examiner*—Bryan Bui
*Assistant Examiner*—Jonathan Moffat
(74) *Attorney, Agent, or Firm*—Ingrassia Fisher Lorenz, P.C.

(57) ABSTRACT

A method is provided for measuring edge exclusion on a workpiece that includes a wafer having a film disposed thereon. The method is performed by a CMP system employing a platen and a thickness sensor coupled to the platen and positioned to repeatedly travel a path over the edge of the film during polishing. The method comprises measuring the thickness of the workpiece during selected iterations of the probe path, and establishing from the wafer thickness measurements the length of time the probe is over the film ($t_{on}$) during the selected iterations. Edge exclusion is determined for at least one iteration utilizing a function related to $t_{on}$.

18 Claims, 8 Drawing Sheets

METHOD FOR MONITORING EDGE EXCLUSION DURING CHEMICAL MECHANICAL PLANARIZATION

FIELD OF THE INVENTION

The present invention generally relates to semiconductor processing and, more particularly, to a method for monitoring edge exclusion during the chemical mechanical planarization of a semiconductor wafer.

BACKGROUND OF THE INVENTION

Chemical mechanical polishing, also known as chemical mechanical planarization (referred to herein collectively as "CMP"), has been widely utilized for the planarization of semiconductor wafers. CMP produces a substantially smooth, planar face on a major surface of the wafer (referred to herein as the wafer's front surface) to prepare the wafer for subsequent fabrication processes (e.g., photo-resist coating, pattern definition, etc.). During CMP, an unprocessed wafer is typically first transferred to a wafer carrier head, which presses the wafer against a polish pad (or other polishing surface) supported by a platen. Polishing slurry is introduced between the wafer's front surface and the polish pad, and relative motion (e.g., rotational, orbital, and/or linear) is initiated between the polish pad and the carrier head. The mechanical abrasion of the polish pad and the chemical interaction of the slurry gradually remove topographical irregularities present on the wafer's front surface to produce a planar surface.

One known type of carrier head comprises a housing having a flexible bladder coupled thereto, which contacts the back (i.e., the unpolished) surface of the wafer during polishing. The housing and the bladder cooperate to form a plurality of concentric pressure chambers or plenums behind the bladder. During CMP, the pressure within each of these plenums is independently adjusted to vary the force applied to the wafer's back surface by the bladder at different annular zones and consequently control the rate removal at different annular zones along the wafer's front surface. In this manner, the carrier head may compensate for topographical variations on wafer's front surface. For example, if a particular portion of wafer's front surface is determined to be relatively thick, the pressure within the corresponding plenum may be increased to intensify the rate of removal proximate the thicker area. Plenum pressure adjustments are typically performed by a closed-loop control (CLC) system, which may comprise a central controller and a thickness measuring system.

One known type of thickness measuring system is an induction system. An induction system employs one or more eddy current probes, which may be fixedly disposed within the polishing platen at different radial positions. As the platen moves relative to the wafer, the eddy current probes gather wafer thickness readings. The controller compiles the wafer thickness readings to produce a topographical wafer map, which the controller then utilizes to determine appropriate plenum pressure adjustments.

Another known type of thickness measuring system is an optical probe system. An optical probe system employs one or more optical probes which may be fixedly disposed within the polishing platen at different radial positions. As the platen moves relative to the wafer, the optical probes gather wafer thickness readings. The controller compiles the wafer thickness readings to produce a topographical wafer map, which the controller then utilizes to determine appropriate plenum pressure adjustments. The optical probes may employ specific wavelengths of light such as the visible spectrum, infrared, or ultraviolet.

To accurately compile the wafer thickness data received from the thickness-sensing probes, the controller must estimate probe radial position for each wafer thickness measurement. Generally, probe location is determined by reference to a metallic (e.g., copper) film deposited on the wafer's front surface during patterning. The outer edge of the film and the outer edge of the wafer are typically separated by an annular gap, which is commonly referred to as edge exclusion. This annular gap has a predetermined width or edge exclusion value, which may be, for example, 3 millimeters for a 300 millimeter wafer. Conventional probe location methods assume a constant edge exclusion value in estimating probe radial position. That is, such methods estimate a probe's radial position to be the edge exclusion value (e.g., 3 millimeters) away for the outer edge of the wafer at the moment the probe sweeps across the film's outer edge.

In practice, edge exclusion often does not remain constant during wafer processing. Instead, the outer edge of the metallic film tends to recede inward. This phenomenon of "edge burn" results in an increase in edge exclusion. In certain instances, edge burn may approach or even exceed 10 millimeters. Due to this change in edge exclusion, conventional probe location methods often inaccurately estimate the true radial positions of the probes and thus assign incorrect probe radial positions to the wafer thickness measurements. As a result, such probe location methods are prone to produce inaccurate wafer maps, which lead to improper plenum pressure adjustments, a less precise polishing process, and, ultimately, a lower die yield.

In view of the above, it should be appreciated that it would be desirable to provide a method for monitoring the change in edge exclusion during CMP processing that allows for a more accurate estimation of probe radial position. Other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements, and.

DETAILED DESCRIPTION OF EXEMPLARY EMBODIMENTS

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
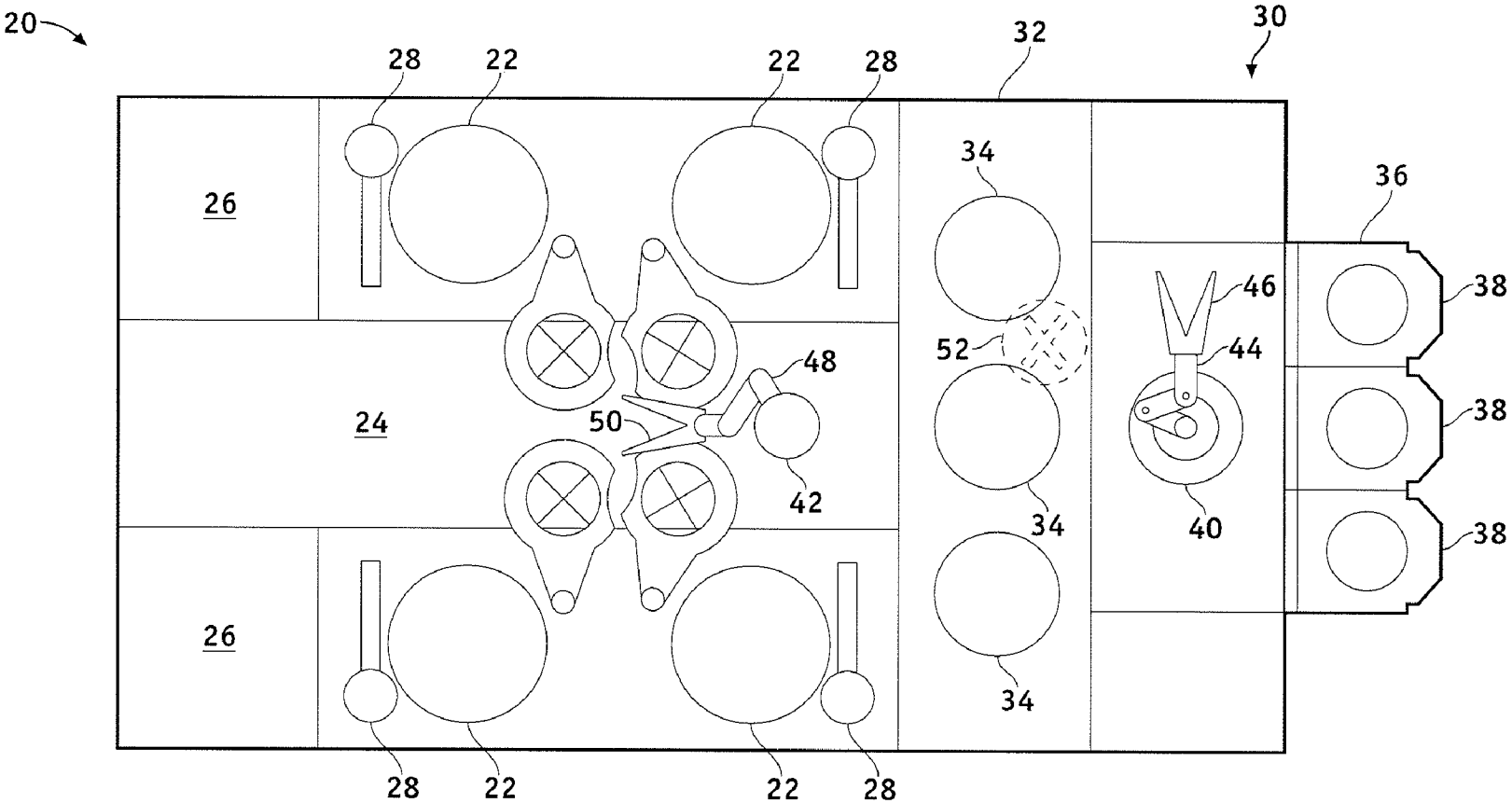
FIG. 1 (PRIOR ART)
FIG. 1 is top functional view of a conventional CMP apparatus.

FIG. 1 is a top functional view of a CMP apparatus 20 comprising a plurality of CMP systems 22, which are arranged in two rows and separated by a service access corridor 24. Electrical cabinets 26 may be disposed on either side of corridor 24 to provide storage space for electrical boards, controllers, and the like. CMP systems 22 each comprise a carrier head and a polish pad, which are described in detail below in conjunction with FIGS. 2 and 3. Each polish pad is periodically conditioned by a pad conditioner 28, which may comprise an abrasive element attached to an arm configured to pivot from an off-pad location (illustrated) to a conditioning position whereat the abrasive element sweeps across the polish pad.

A front end module 30 resides adjacent CMP systems 22 opposite cabinets 26. Front end module 30 includes: (1) a cleaning module 32 having a plurality of cleaning stations 34 thereon, and (2) a wafer cache station 36 that accommodates a plurality of wafer caches 38. During the CMP process, unprocessed wafers are retrieved from wafer caches 38, cleaned at cleaning stations 34, and then planarized/polished by CMP systems 22. After planarization/polishing, the processed wafers may be transferred to cleaning stations 34 for post-planarization cleaning and subsequently returned to caches 38.

In the illustrated embodiment, first and second transfer robots 40 and 42 are mounted on front end module 30 and utilized to transport wafers amongst the various stations of CMP apparatus 20. Front end transfer robot 40 comprises an extensible arm 44 having an end effector 46 attached to an end thereof. Similarly, transfer robot 42 comprises an extensible arm 48 having an end effector 50 attached thereto. Transfer robots 40 and 42 are configured to grasp each wafer such that end effectors 46 and 50 contact only the outer periphery of the wafer's back surface or the wafer's outer edge. During operation of CMP apparatus 20, first transfer robot 40 transfers selected wafers from caches 38 to a wafer handoff station 52 disposed on cleaning module 32, which resides at a location accessible to both front end robot 40 and transfer robot 42 (e.g., underneath cleaning stations 34). Second transfer robot 42 then retrieves the wafer from handoff station 52, inverts the wafer so that its front surface is facing downward, and delivers the transferred wafer to a load cup associated with one of CMP systems 22. The CMP system 22 receiving the wafer subsequently planarizes the wafer's front surface in the manner described below.

Figure 2:
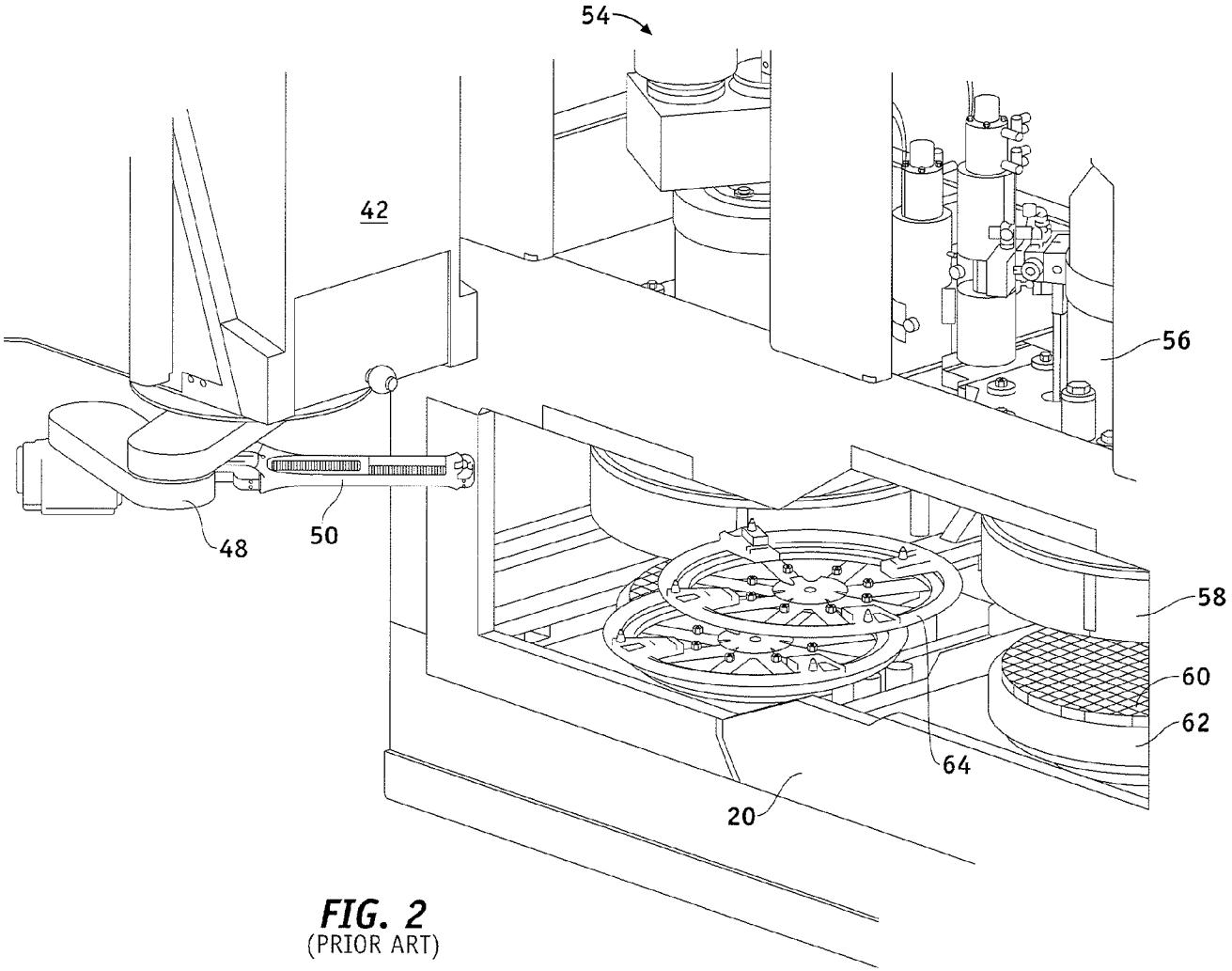
FIG. 2 (PRIOR ART)
FIG. 2 is an isometric view of two CMP systems employed in the CMP apparatus shown in FIG. 1.

FIG. 2 is an isometric view of two neighboring CMP systems 54 and 56 employed by CMP apparatus 20. CMP systems 54 and 56 are substantially identical and operate in a similar manner; thus, only CMP system 56 will be described herein below. CMP system 56 comprises a wafer carrier head 58 and a polish pad 60 deployed on a polish platen 62. CMP system 56 may also include a load cup 64 that is configured to transfer wafers to and from carrier head 58. Load cup 64 is configured to pivot about an axis from an off-load position (illustrated) to a load position underneath and aligned with wafer carrier head 58. When in the off-load position, load cup 64 may receive an unprocessed wafer from transfer robot 42. Load cup 64 then pivots about its axis to the load position in which load cup 64 is raised to contact wafer carrier head 58 to transfer the wafer thereto. After wafer transfer, load cup 64 lowers to a plane beneath wafer carrier head 58 and pivots to the off-load position.

After load cup 64 has returned to the off-load position, wafer carrier head 58 is lowered to place the wafer's front surface in contact with polish pad 60. Polish slurry is supplied to the surface of polish pad 60, and relative motion (e.g., rotational, orbital, and/or linear) is initiated between pad 60 and the wafer carrier head 58 and, thus, the wafer held by carrier head 58. The wafer's front surface is gradually planarized by the chemical reaction of the slurry with the constituents of the wafer mechanical and the abrasive action between polish pad 60 and the wafer's front surface. When the planarization is complete or when the process has reached a predetermined intermediate point, the CMP process terminates and carrier head 58 is raised to a position at which carrier head 58 no longer contacts polish pad 60. Load cup 64 again pivots about its axis to the load position, and the processed wafer is transferred from wafer carrier head 58 to load cup 64. If desired, load cup 64 may spray the planarized surface of the processed wafer with a fluid (e.g., a surfactant) to better maintain the hydrophilic state of the planarized surface. Next, load cup 64 pivots about its axis to the off-load position in which transfer robot 42 (FIG. 1) removes the processed wafer. The back or unprocessed side of the wafer may be sprayed with a fluid to help remove residue. Transfer robot 42 may then transfer the processed wafer to another CMP system 22 for further processing or, instead, to a cleaning station 34 for post-processing cleaning. After the wafer has been sufficiently planarized and cleaned in this manner, transfer robot 40 returns the processed wafer to caches 38 for transport.

Figure 3:
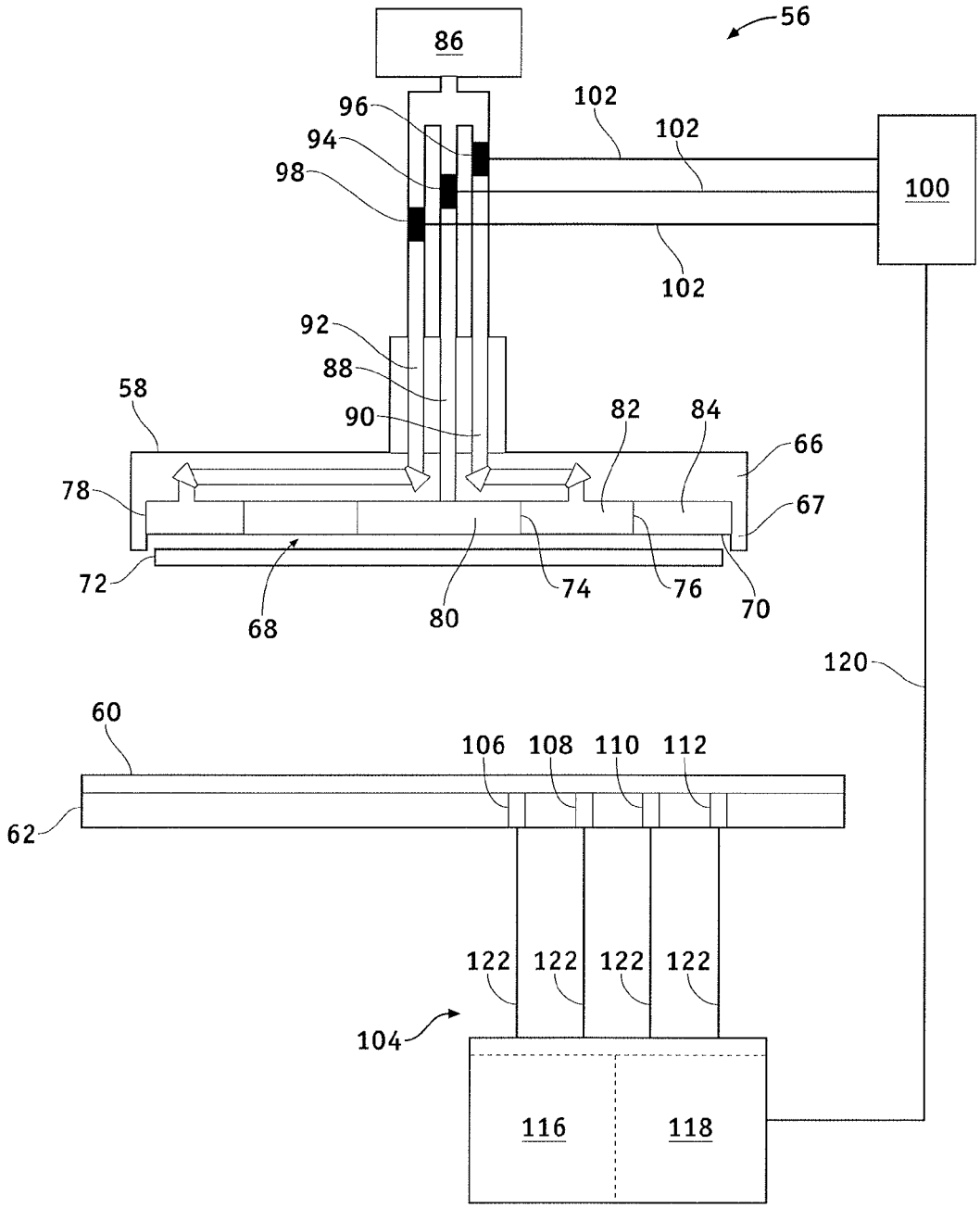
FIG. 3 (PRIOR ART)
FIG. 3 is a cross-sectional view of one of the CMP system shown in FIG. 2.

FIG. 3 is a cross-sectional view of CMP system 56, including carrier head 58. Carrier head 58 comprises a housing 66, a bladder 68 coupled to a lower portion of housing 66, and a retaining ring 67. Retaining ring 67 is attached to a lower peripheral portion of housing 66 and encircles bladder 68. Retaining ring 67 serves to pre-stress or pre-compress polish pad 60 to protect the leading edge of a wafer 72 during polishing. Bladder 68 includes a flexible diaphragm 70, which contacts the back surface of a wafer 72 to force the front surface of wafer 72 against polish pad 60. A plurality of annular walls extends from diaphragm 70. In the illustrated embodiment, three such walls extend from diaphragm 70: an inner annular wall 74, an intermediate annular wall 76, and an outer annular wall 78. Walls 74, 76, and 78 are sealingly coupled to housing 66 to form a plurality of concentric pressure chambers or plenums within carrier head 58; i.e., an inner plenum 80, an intermediate plenum 82, and an outer plenum 84. As will be seen, the pressure within each of these plenums may be independently adjusted to control the force exerted by diaphragm 70 along different annular zones on the back surface of wafer 72.

To permit selective pressurization of the plenums, CMP system 56 includes a plurality of pneumatic passages that extends through carrier head 58 and that fluidly couples plenums 80, 82, and 84 to a pump 86. For example, CMP system may include three such pneumatic passages (i.e., passages 88, 90, and 92), which enable fluid communication with plenums 80, 82, and 84, respectively. Pressure regulators 94, 96, and 98 are fluidly coupled to pneumatic passages 88, 90, and 92, respectively. A central controller 100 is coupled to each of pressure regulators 94, 96, and 98 by way of a plurality of communication lines 102. Controller 100 utilizes regulators 94, 96, and 98 to control the pressure in plenums 74, 76, and 78, respectively. By regulating plenum pressure in this manner, controller 100 may control the pressure exerted by diaphragm 70 on the back surface of wafer 72 and, consequently, the rate of removal on the front surface of wafer 72 along different annular bands. If, for example, controller 100 commands regulator 98 to increase the pressure in outer plenum 84, diaphragm 70 will exert a greater downward force along an outer annular band across the back surface of wafer 72, which will result in an increase in the rate of removal along an outer annular band on the front surface of wafer 72.

CMP system 56 further comprises an induction system 104 that provides controller 100 with thickness measurements of wafer 72, which controller 100 utilizes in determining appropriate pressure adjustments. The thickness measurements are indicative of the presence or absence of a metallic film (described below) on the surface of wafer 72. A wide variety of induction systems may be employed, and each induction system may utilize one or more probes. In the illustrated embodiment, induction system 104 comprises four eddy current probes (i.e., probes 106, 108, 110, and 112), which reside within polishing platen 62 beneath polishing pad 60. Probes 106, 108, 110, and 112 are fixedly disposed at different radial positions within platen 62 to collect data points from concentric annular bands on the front surface of wafer 72. If CMP system 56 utilizes an orbital polishing motion, each probe 106, 108, 110, and 112 may monitor a single annular region during polishing, which may overlap with neighboring regions to provide redundancy.

Induction system 104 further comprises a drive system 116 and a sensing system 118, which are each coupled to controller 100 via communication line 120. Drive system 116 and sensing system 118 are coupled to eddy current probes 106, 108, 110, and 112 via cables 122. During operation of CMP system 56, drive system 116 causes eddy current probes 106, 108, 110, and 112 to induce eddy currents within wafer 72, and sensing system 118 utilizes probes 106, 108, 110, and 112 to register eddy current measurements indicative of wafer thickness. Sensing system 118 relays the received wafer thickness data to controller 100, which then assigns a probe radial position to each thickness measurement to produce a wafer map. In preferred embodiments, induction system 104, controller 100, and the pneumatic system controlled cooperate to form a closed loop control (CLC) system. That is, controller 100 may determine and automatically perfonm plenum pressure adjustments in response to the wafer thickness data received from induction system 104.

CMP system 56 may further comprise an optical system that provides controller 100 with thickness measurements of wafer 72, which controller 100 utilizes in determining appropriate pressure adjustments. The optical system may comprise one or more probes located beneath the polishing pad to transmit light to, and receive reflected light from, the front surface of the wafer.

Figure 4:
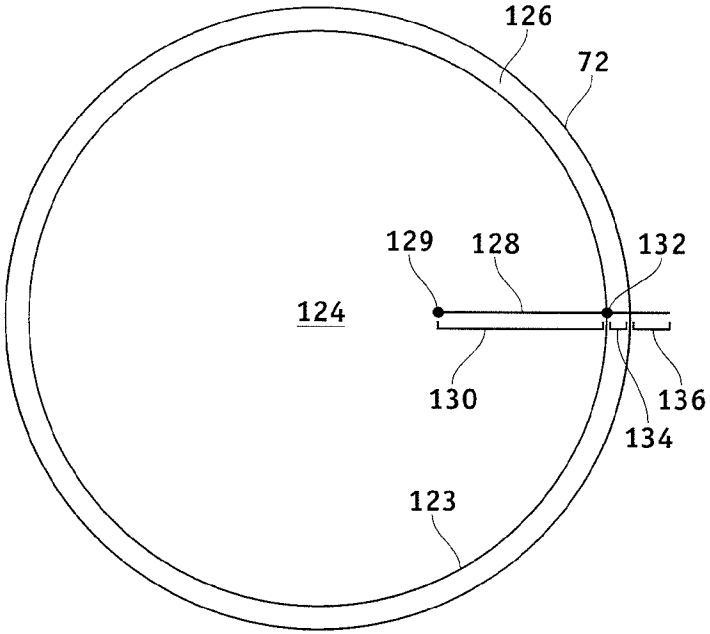
FIG. 4 is a top view of the wafer shown in FIG. 3 illustrating a first, linear path a thickness-sensing probe may repeatedly travel over the wafer's surface during polishing.

FIG. 4 is a top view of workpiece comprising a wafer 72 having a metallic film 124 deposited thereon. Metallic film 124 is preferably copper, but may comprise a variety of other metals, including aluminum, gold, silver, titanium, or tantalum. Metallic film 124 does not extend to the outer edge of wafer 72; instead, an annular gap 126 separates the outer edge of metallic film 124 from the outer edge of wafer 72 (referred to as "edge exclusion"). Prior to polishing, annular gap 126 has a pre-determined gap width or edge exclusion value, which may be, for example, 3 millimeters for a 300 millimeter wafer. During polishing, the width of annular gap 126 increases due to the occurrence of edge burn; i.e., the gradual wearing away or recession of the outer edge 123 of film 124.

Probe location methods utilize the outer edge of metallic film 124 as a reference point to determine the radial position of the thickness-sensing probes. For multi-probe systems, the radial position of a single, reference probe is first determined and the radial positions of the remaining probes, which are fixedly disposed relative to the reference probe, are subsequently determined. For example, controller 100 (FIG. 3) may utilize probe 112 (FIG. 3) as the reference probe. Controller 100 determines the radial position of probe 112 by monitoring the wafer thickness readings gathered as probe 112 travels over the front surface of wafer 72. From the wafer thickness readings, controller 100 identifies the time at which probe 112 passes over the outer edge of film 124. In accordance with an embodiment of the present invention (described in detail below), controller 100 also utilizes the wafer thickness readings provided by probe 112 to continually determine the change in edge exclusion (i.e., the width of gap 126). As will be seen, by considering the change in edge exclusion in conjunction with the times at which probe 112 passes over the outer edge of film 124, controller 100 may identify the radial position of probe 112 and subsequently the radial positions of probes 106, 108, and 110 with relative accuracy.

Referring to FIG. 3, probe 112 sweeps over the front surface of wafer 72 as polishing platen 62 moves relative to carrier head 58. The path traveled by probe 112 over wafer 72 is dependent upon characteristics of the relative motion initiated between polishing platen 62 and carrier head 58. The characteristics of the relative motion between these components may vary amongst different CMP systems. In addition, the shape and dimension of the probe path may also vary. Although the following exemplary embodiments of the inventive method describe probe paths having particular geometries, it should be understood that the invention is not limited to CMP systems employing any particular type of probe or probe path geometry. The inventive method may be employed by any suitable CMP system wherein at least one probe capable of measuring wafer thickness repeatedly passes over the outer edge of the metallic film deposited on the wafer's front surface.

Referring collectively to FIGS. 3 and 4, assume, for the time being, that probe 112 travels a linear path 128 and passes over different portions of wafer 72. Beginning from staring position 129, probe 112 first passes over a portion of wafer 126 covered by film 124 (segment 130), crosses over the outer edge of film 124 (point 132), and moves onto a portion of wafer 126 not covered by film 124 (segment 134). Next, probe 112 moves off of wafer 72 and passes over retaining ring 67 (segment 136) and, perhaps, a portion of polish pad 60 (not shown). After reaching the outer terminus of path 128, probe 112 then moves back toward the center of wafer 72 again passing over retaining ring 67, the exposed portion of the wafer, and the portion of wafer 126 covered by film 124. While repeatedly traveling path 128 in this manner, probe 112 continually records wafer thickness measurements of wafer 72. Controller 100 analyzes the wafer thickness measurements captured by probe 112 to determine the duration of time probe 126 spends over metallic film 124 (segment 130) and the duration of time probe 126 spends not over metallic film 124 (segment 134 and 136) in the manner described below.

Figure 5:
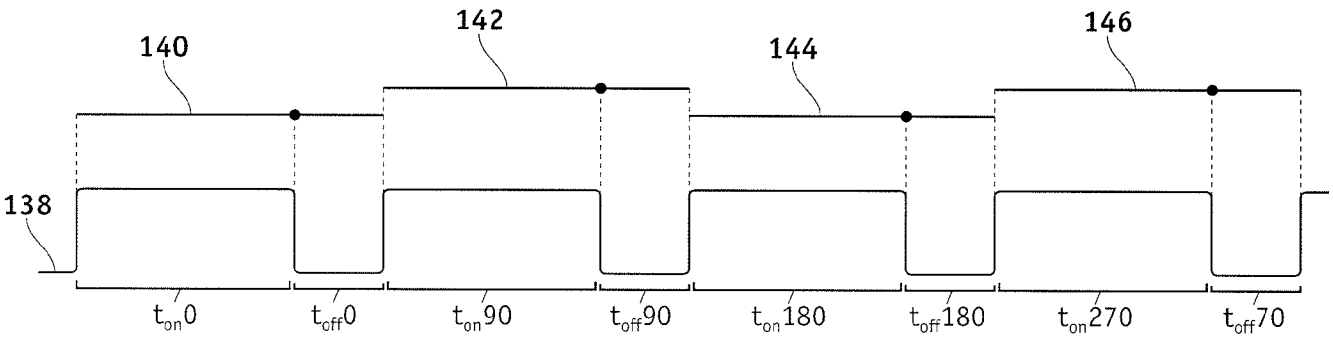
FIG. 5 is a graph illustrating wafer thickness data gathered as the probe performs four successive iterations of the first probe path shown in FIG. 4.

FIG. 5 illustrates a series of wafer thickness measurements 138 taken by probe 112 during four successive iterations of path 128 (i.e., iterations 140, 142, 144, and 146). In this case, and by way of example only, the relative motion between carrier head 58 (FIG. 3) and platen 62 is such that wafer 72 rotates 90° relative to platen 62 during each successive iteration of path 128. During iteration 140 of path 128, wafer 72 resides in an initial rotational position (0°) relative to platen 62. At iterations 142, 144, and 146, wafer 72 has rotated 90°, 180°, and 270°, respectively, from the initial rotational position. As probe 112 completes the final iteration in the series (i.e., iteration 146), wafer 72 again rotates 90° relative to platen 62 thus returning to the initial rotation position (0°). As indicated in FIG. 5, controller 100 monitors the time probe 112 is over film 124 ($t_{on}$) and the time probe 124 is not over film 124 ($t_{off}$) for each iteration of path 128 by continually analyzing the change in wafer thickness readings.

Figure 6:
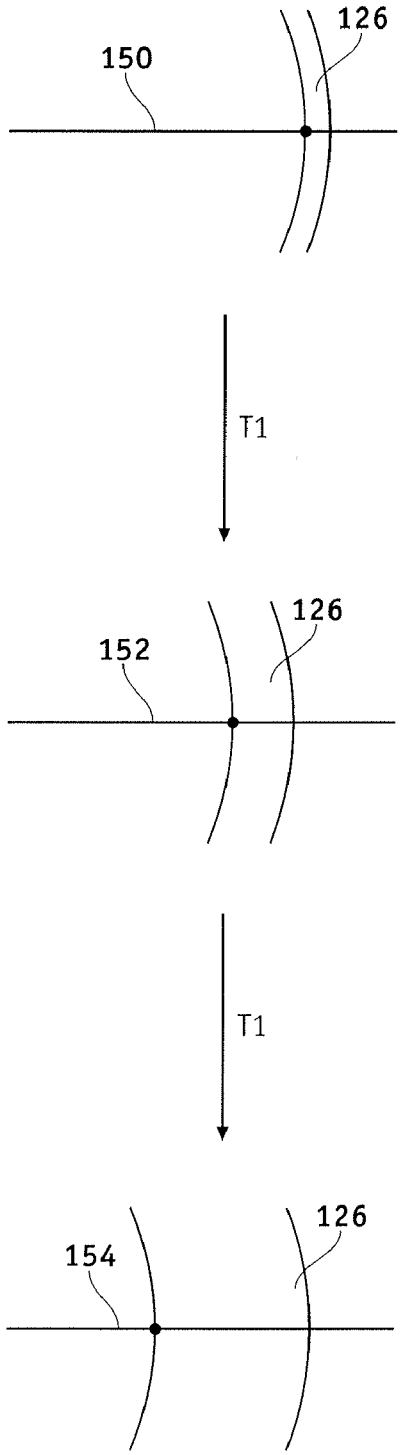
FIG. 6 is a top view of a portion of the wafer shown in FIG. 3 and the first probe path shown at three different time frames during the polishing process.

FIG. 6 illustrates three non-successive iterations of path 128 (i.e., iterations 150, 152, and 154) performed by probe 112 at different time frames in the polishing process. Iteration 150 is performed at an initial time frame, iteration 152 is performed during a time frame $T_1$ seconds after iteration 150, and iteration 154 is performed at a time frame $T_1$ seconds after iteration 152. In this embodiment, CMP system 56 is configured such that each iteration occurs at substantially the same rotational position (e.g., 0°). As may be appreciated by comparing the width of gap 126 for iterations 150, 152, and 154, edge exclusion increases as the CMP process progresses.

Figure 7:
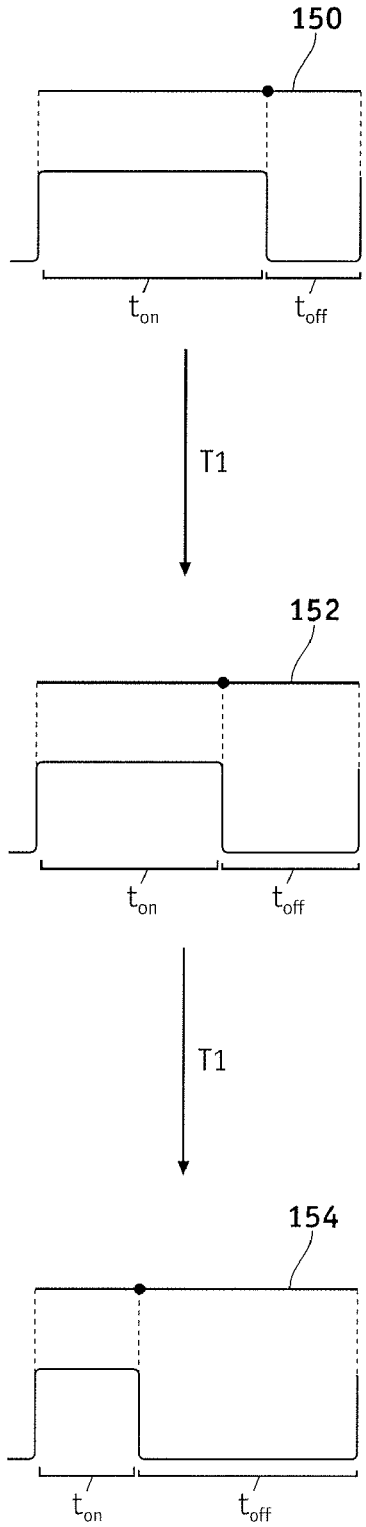
FIG. 7 is a graph illustrating wafer thickness data gathered as the probe performs the three iterations of the first probe path shown in FIG. 6.

FIG. 7 illustrates the manner in which controller 100 utilizes the wafer thickness measurements recorded during a plurality of selected iterations (e.g., iterations 150, 152, and 154) to determine individual $t_{on}$ and $t_{off}$ measurements for each of the selected iterations. That is, controller 100 monitors the duration of time during which the thickness measurements received from probe 112 are indicative of the presence of film 124 and the duration of time the thickness measurements are indicative of the absence of film 124. For example, referring to FIG. 6, it can be seen that the majority of iteration 150 occurs over film 124. Thus, during iteration 150, probe 112 will relay wafer thickness measurements indicative of the presence of film 124 for a relatively long period of time. As a result, $t_{on}$ is substantially greater than $t_{off}$ as indicated in FIG. 7 at 150. In contrast, a majority of iteration 154 occurs over an exposed portion of the wafer and thus not over film 124. Consequently, probe 112 will relay wafer thickness measurements indicative of the presence of film 124 for a relatively short period of time. As a result, $t_{on}$ will be substantially less than $t_{off}$ as indicated in FIG. 7 at 154.

Controller 100 utilizes a function related to $t_{on}$ to determine edge exclusion. The function utilized by controller 100 may be proportional to $t_{on}$ and preferably comprises a ratio of $t_{on}$ and $t_{off}$. Equation 1 below provides an example of a suitable function, which is proportional to $t_{on}$ and which comprises a ratio of $t_{on}$ to $t_{off}$.

$$\eta = \frac{t_{on}}{t_{off}} \tag{1}$$

In accordance with Equation 1, η will decrease as $t_{on}$ decreases and/or as $t_{off}$ increases. As edge exclusion (i.e., the width of gap 126) increases, $t_{on}$ decreases and $t_{off}$ increases. Therefore, η will decrease as edge exclusion increases.

Figure 8:
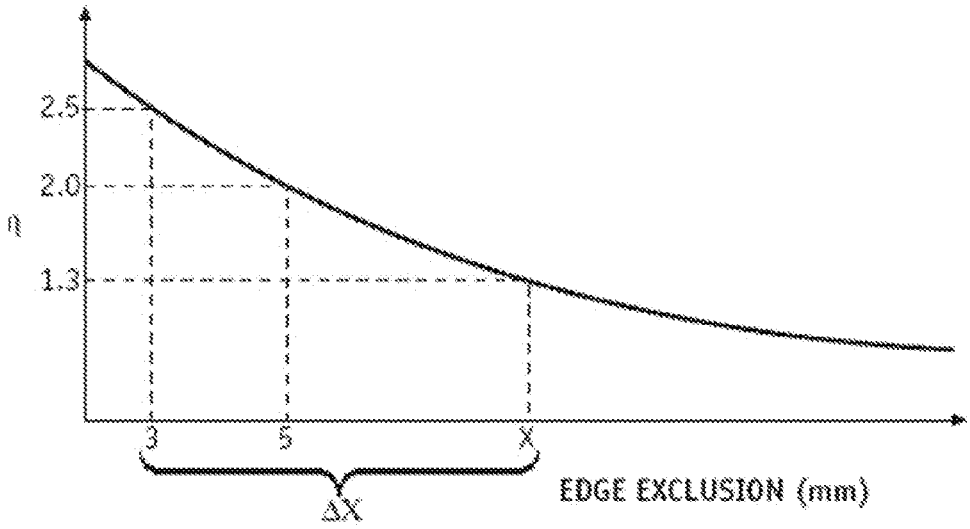
FIG. 8 is a graph illustrating the relationship between η (to be defined below) and edge exclusion wherein edge exclusion is plotted on the horizontal axis and η is plotted on the vertical axis.

FIG. 8 illustrates the relationship between η and edge exclusion wherein edge exclusion is plotted on the horizontal axis and η is plotted on the vertical axis. After determining η for a particular time in the polishing process, controller 100 may utilize a suitable function of $t_{on}$ and $t_{off}$ to determine edge exclusion for the determined valve of η. For example, controller 100 may utilize the function shown in FIG. 8 to convert an η of approximately 2 to an edge exclusion value of approximately 5 millimeters. Alternatively, controller 100 may utilize a two dimensional look-up table to convert a determined η to a corresponding edge exclusion value. After the edge exclusion value is known, the radial position of probe 112 may be estimated. For example, if the edge exclusion value is determine to be 5 millimeters, the radial position of probe 112 is approximately 5 millimeters away from the outer edge of wafer 72 when probe 112 passes over the edge of film 124.

The above-described embodiment of the inventive method provides a relatively accurate estimation of radial probe position. However, in certain CMP systems, the reference probe may not pass over precisely the same portion of the wafer during each iteration at a particular rotational angle due to, for example, positional drift of the wafer within the wafer pocket. For example, probe 112 may not perform iterations 150, 152, and 154 (FIG. 6) over the same portion of wafer 72. FIGS. 9-12 illustrate a second embodiment of the present invention that allows controller 100 to more accurately locate probe 112 and, therefore, probes 106, 108, and 110 despite the occurrence of wafer drift.

As stated above, the path traveled by outer probe 112 will vary in relation to the nature of the relative motion between carrier head 58 and platen 62. In the exemplary embodiment described below, carrier head 58 and platen 62 move such that outer probe 112 travels a substantially circular path over the front surface of wafer 72 (e.g., carrier head 58 may rotate while platen 62 orbits and/or oscillates). This may be appreciated by referring to FIG. 9, which illustrates four selected iterations (i.e., iterations 160, 162, 164, and 166) of the circular path traveled by outer probe 112 over the front surface of wafer 72 during polishing. During iteration 160, wafer 72 resides in an initial rotational position (0°) relative to platen 62. At iterations 162, 164, and 166, wafer 72 has rotated approximately 90°, 180°, and 270°, respectively, from the initial rotational position.

Figure 10:
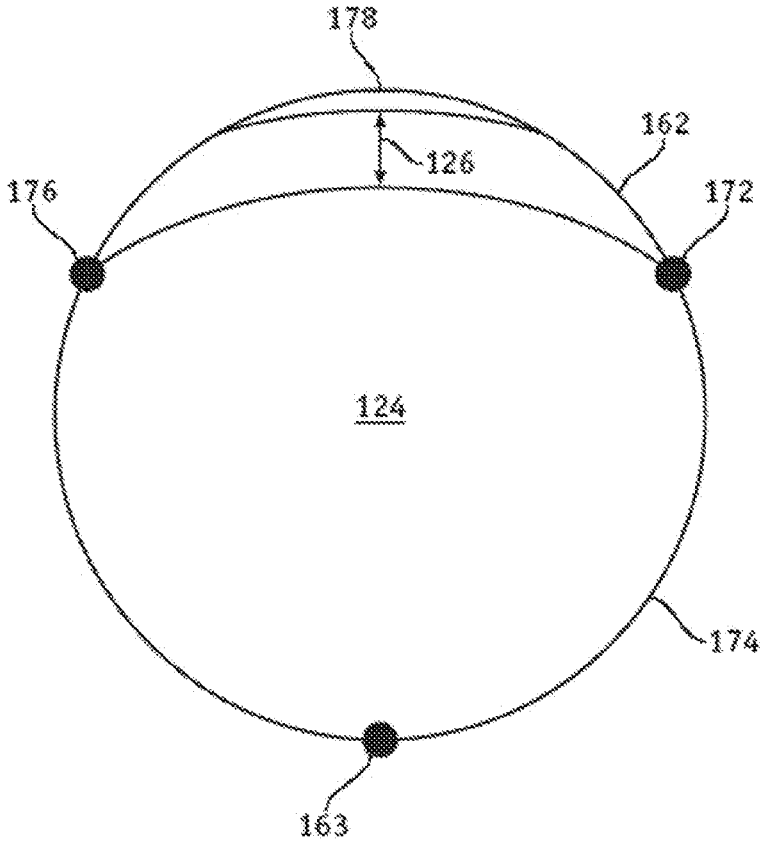
FIG. 10 is a graph of η (y-axis) versus rotational position (x-axis) illustrating a first time frame early in the polishing process and a second, subsequent time frame.

FIG. 10 illustrates iteration 162 in greater detail. Probe 112 may begin at position 163 and perform iteration 162 in a clockwise manner. In so doing, probe 112 first crosses over the edge of film 124 at point 176 and travels along segment 178. Secondly, probe 112 crosses over the edge of film 124 at point 172, travels along segment 174, and returns to starting position 163. As probe 112 performs iteration 162 in this manner, controller 100 monitors the time probe 112 spends over film 124 ($t_{on}$) and the time probe 124 spends not over film 124 ($t_{off}$). In particular, controller 100 will monitor the time required from probe 124 to travel clockwise from point 172 to point 176 ($t_{on}$) and from point 176 to point 172 ($t_{off}$). Controller 100 monitors $t_{on}$ and $t_{off}$ in this manner for each iteration of the probe path, including iterations 160, 164, and 166.

Figure 9:
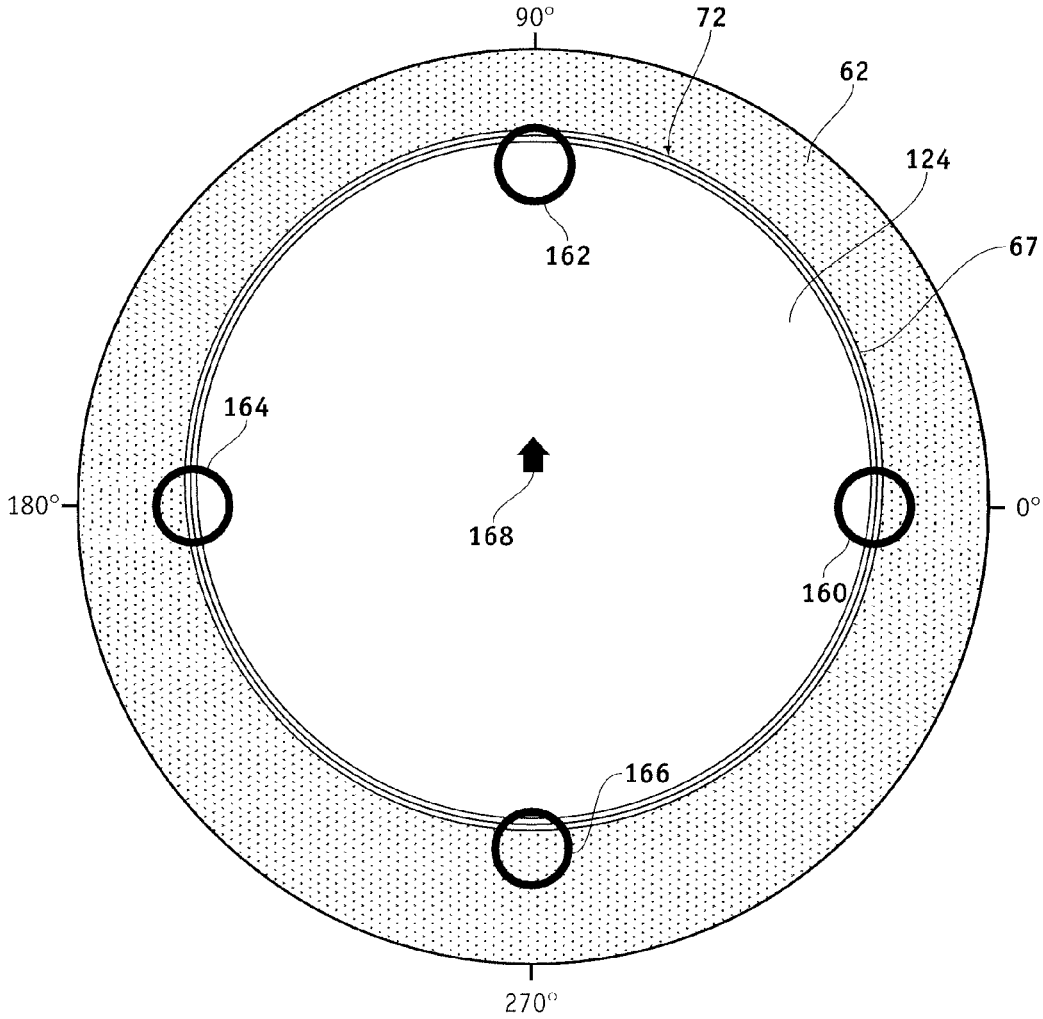
FIG. 9 is a top view of the wafer shown in FIG. 3 illustrating a second, circular path a probe may repeatedly travel over the wafer's surface during polishing.

As indicated in FIG. 9 by arrow 168, the rotational axis of wafer 124 is offset from the center of platen 62. This offset may be, for example, equal to approximately ¼ of the diameter of the path traveled during each of iterations 160, 162, 164, and 166. As a result, probe 112 will spend a relatively long period of time over film 124 during iteration 162 (and later iterations occurring at or near a rotational position of 90°), a relatively short period of time over film 124 during iteration 166 (and later iterations occurring at or near a rotational position of 270°), and an intermediate period of time over film 124 during iterations 160 and 164 (and later iterations occurring at or near a rotational position of 0 and 180°, respectively). Consequently, the values of $\eta$ will vary in relation to the rotational position of wafer 72 relative to platen 62.

Figure 11:
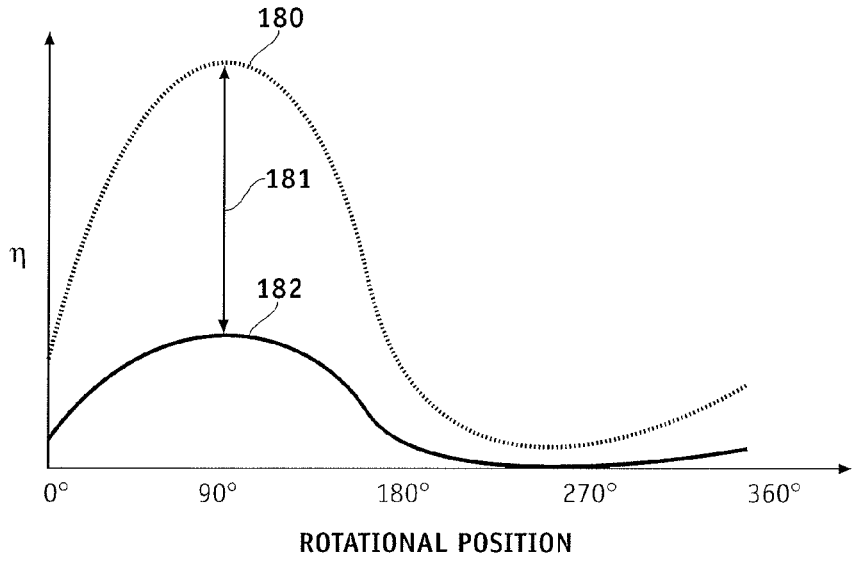
FIG. 11 is a top view of an iteration of a second, circular probe path shown in FIG. 9.

FIG. 11 illustrates the relationship of $\eta$ (y-axis) as a function of rotational position (x-axis) including first and second functions 180 and 182, respectively. Function 180 comprises a first set of data indicative of the rotational position of wafer 72 with respect to platen 62 at which each occurrence of $t_{on}$ and $t_{off}$ is measured during a first time frame. Similarly, function 182 comprises a second set of data indicative of the rotational position of wafer 72 with respect to platen 62 at which each occurrence of $t_{on}$ and $t_{off}$ is measured during a second time frame occurring after first time frame. At the beginning of the first time frame (function 180), edge exclusion is a known, predetermined value. For example, edge exclusion may be 3 millimeters for a 300 millimeter wafer. Controller 100 utilizes the predetermined edge exclusion to estimate the radial position of probe 112 during the second time frame.

To determine edge exclusion for function 182, a rotational position of wafer 72 relative to platen 62 is first selected. In the exemplary embodiment, a rotational position of 90° ($\eta_{max}$) is selected as indicated in FIG. 11 at 181. Next, controller 100 compares difference in $\eta_{max}$ at the selected rotational position 90° between function 180 and function 182 ($\Delta\eta_{max}$). Controller 100 then utilizes $\Delta\eta_{max}$ to determine the change in edge exclusion. For example, as indicated in FIG. 8, function 180 is generated at an initial time in the CMP process when the edge exclusion value is a predetermined value (e.g., 3 millimeters). During this initial time, $\eta_{max}$ may be determined to be 2.5. Function 182 is generated at a later time in the polishing process when $\eta_{max}$ may be, for example, 1.3. Thus, $\Delta\eta_{max}$ is 1.2. Controller 100 utilizes the predetermined edge exclusion value and $\Delta\eta_{max}$ to determine the change in edge exclusion ($\Delta x$) by reference to function or characteristic of FIG. 8. Controller 100 may determine $\Delta x$ to be, for example, 4 millimeters. Controller 100 adds $\Delta x$ to the initial edge exclusion value to determine edge exclusion during the second time frame associated with function 182. In this case, controller 100 will determine edge exclusion to be approximately 7 millimeters for the second time frame associated with function 182. Controller 100 then utilizes the derived edge exclusion value or annular gap width to determine the radial position of probe 112. For example, controller 100 will estimate the radial position of probe 112 to be 7 millimeters away from the edge of wafer 72 when probe 112 sweeps over the outer edge of film 124 during the second time frame.

Figure 12:
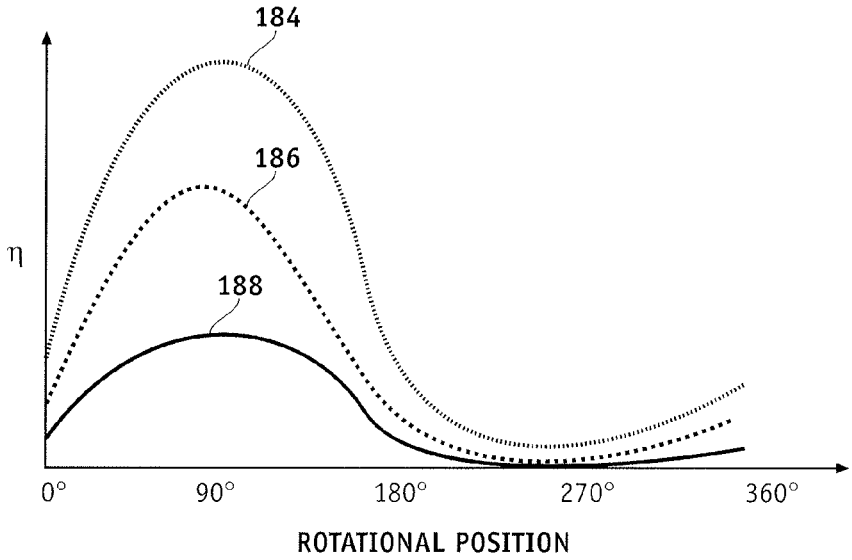
FIG. 12 is a graph of η (y-axis) versus rotational position (x-axis) illustrating a family of predetermined functions, each associated with a different edge exclusion value.

Alternatively, controller 100 may determine edge exclusion (annular gap width) by reference to a family of functions, each function being associated with a particular edge exclusion characteristic. For example, as indicated in FIG. 12, controller 100 collects a first set of data indicative of the rotational position of wafer 72 relative to platen 62 at which $t_{on}$ and $t_{off}$ are measured. Controller 100 may then compare this first set of data to a family of functions of $t_{on}/t_{off}$ versus rotational position; e.g., functions 184, 186, and 188. Each function may be associated with a particular edge exclusion value; for example, functions 184, 186, and 188 may be associated with edge exclusion values of 3, 5, and 7 millimeters, respectively. Controller 100 determines which of the family of functions most resembles the first set of data and estimates the edge exclusion value associated therewith to be the current edge exclusion. For example, if the data most closely fits function 186, controller 100 will estimate the current edge exclusion to be 5 millimeters.

The edge exclusion value is then used to determine the radial position of probe 112. Based on the fixed positions of the other probes relative to probe 112, the radial positions can be determined for probes 106, 108, and 110. The positions of the probes are then used to produce accurate wafer thickness maps, which are used to make more precise plenum pressure adjustments. That is, by determining probe location relative to the edge of the wafer, controller 100 may determine with a high degree of accuracy the location at which each of the thickness measurements was taken. Controller 100 compiles these measurements to produce a continually-evolving three dimensional wafer map, which indicates the various topographical features of wafer 72. The resulting wafer map may be utilized for a variety of purposes (e.g., to determine the polish characteristics of polish pad 60 and/or CMP system 56). In a CLC system, controller 100 may repeatedly refer to the wafer map to determine appropriate plenum pressure adjustments. For example, if determining from the wafer map that a portion of wafer 72 is relatively thick, controller 100 may command the pressure regulator to increase the pressure within the plenum corresponding to the thicker area. This increases the rate of removal over the thicker area and ultimately produces a substantially planar topography along the entirety of the front surface of wafer 72.

Considering the foregoing, it should be appreciated that a method for monitoring edge exclusion during CMP processing has been provided that may enable a more accurate estimation of probe radial position. While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A method for measuring edge exclusion on a workpiece in a CMP system, the workpiece including and the CMP system including a platen and a thickness sensor coupled to the platen and positioned to repeatedly travel a path over the edge of the film during polishing, the method comprising:

while polishing the workpiece, measuring the thickness of the workpiece during selected iterations of the probe path;

establishing from the wafer thickness measurements the length of time the probe is over the film ($t_{on}$) during the selected iterations; and determining edge exclusion for at least one iteration utilizing a function related to $t_{on}$.

2. A method according to claim 1 wherein the thickness sensor comprises an induction probe mounted in the platen.

3. A method according to claim 1 wherein the function is proportional to $t_{on}$.

4. A method according to claim 3 further comprising establishing the length of time the probe is not over the film ($t_{off}$) during the selected iterations of the probe path.

5. A method according to claim 4 wherein the function comprises a ratio of $t_{on}$ and $t_{off}$.

6. A method according to claim 5 wherein the workpiece is configured to rotate with respect to the platen, and wherein the method further comprises:

collecting a first set of data indicative of the rotational position of the workpiece with respect to the platen at which each occurrence of $t_{on}$ and $t_{off}$ is measured during a first time frame; and collecting a second set of data indicative of the rotational position of the workpiece with respect to the platen at which each occurrence of $t_{on}$ and $t_{off}$ is measured during a second time frame, the second time frame subsequent to the first time frame.

7. A method according to claim 6 further comprising:

selecting a rotational position of the workpiece relative to the platen; and determining the change in edge exclusion at the second time frame by taking the difference between the ratios at the selected rotational position during the first time frame and the second time frame.

8. A method according to claim 7 wherein edge exclusion at the beginning of the first time frame is predetermined.

9. A method according to claim 5 wherein the workpiece is configured to rotate with respect to the platen, and wherein the method further comprises:

collecting a first set of data indicative of the rotational position of the workpiece with respect to the platen at which $t_{on}$ and $t_{off}$ are measured; and comparing the first set of data to a family of functions of $t_{on}/t_{off}$ versus rotational position, each of the family of functions corresponding to a predetermined edge exclusion.

10. A method for measuring edge exclusion on a workpiece that includes a wafer having a film disposed thereon the method performed by a CMP system employing a platen and a thickness sensor coupled to the platen and positioned to repeatedly travel a path over the edge of the film during polishing, the method comprising:

measuring the thickness of the workpiece during selected iterations of the probe path;

establishing from the wafer thickness measurements the length of time the probe is over the film ($t_{on}$) during the selected iterations and is not over the film ($t_{off}$) during the selected iterations; and determining edge exclusion utilizing a function comprising a ratio of $t_{on}$ to $t_{off}$.

11. A method according to claim 10 wherein the workpiece is configured to rotate with respect to the platen, and wherein the method further comprises:

collecting a first set of data indicative of the rotational position of the workpiece with respect to the platen at which each occurrence of $t_{on}$ and $t_{off}$ is measured during a first time frame;

collecting a second set of data indicative of the rotational position of the workpiece with respect to the platen at which each occurrence of $t_{on}$ and $t_{off}$ is measured during a second time frame, the second time frame subsequent to the first time frame;

selecting a rotational position of the workpiece relative to the platen; and determining the change in edge exclusion at the second time frame by taking the difference between the ratios at the selected rotational position during the first time frame and the second time frame.

12. A method according to claim 11 wherein edge exclusion at the beginning of the first time frame is predetermined.

13. A method according to claim 10 wherein the workpiece is configured to rotate with respect to the platen, and wherein the method further comprises:

collecting a first set of data indicative of the rotational position of the workpiece with respect to the platen at which $t_{on}$ and $t_{off}$ are measured; and comparing the first set of data to a family of functions of $t_{on}/t_{off}$ versus rotational position, each of the family of functions corresponding to a predetermined edge exclusion.

14. A method according to claim 13 wherein the positioning of the platen relative to the wafer is substantially the same for each of the selected iterations of the probe path.

15. A method for determining the radial position of a probe relative to a wafer having a film on the surface thereof separated from the outer edge of the wafer by an annular gap having a gap width, the probe coupled to the platen of a CMP system that is configured to produce relative motion between the platen and the wafer such that the probe repeatedly travels a path over the edge of the film during polishing, the method comprising:

repeatedly measuring the thickness of the wafer as the probe passes over the edge of the film during polishing;

determining from the measured thicknesses the duration of time the probe spends over the film ($t_{on}$) for a selected iteration of the probe path;

estimating the gap width during the selected iteration of the probe path from the $t_{on}$ for the selected iteration of the probe path; and identifying the radial position of the probe during the selected iteration of the probe path utilizing the estimated gap width.

16. A method according to claim 15 wherein the step of identifying comprises determining the radial position of the probe to be the estimated gap width away from the outer edge of the wafer.

17. A method according to claim 15 further comprising:

determining from the measured thicknesses the period of time the probe is over the film ($t_{on}$) for an initial iteration of the probe path during which gap width is known; and determining the gap width during the selected iteration of the probe path from the difference between $t_{on}$ for the initial iteration of the probe path and $t_{on}$ for the selected iteration of the probe path.

18. A method according to claim 15 wherein the CMP system comprises a plurality of probes including a reference probe configured to repeatedly travel a path over the edge of the film during polishing, and wherein the method further comprises:

determining the radial position of the reference probe from $t_{on}$ for the selected iteration of the probe path; and determining the radial positions of the remaining ones of the plurality of probes utilizing the radial position of the reference probe.

* * * * *